US008111497B2

(12) United States Patent
Blackburn et al.

(10) Patent No.: US 8,111,497 B2
(45) Date of Patent: Feb. 7, 2012

(54) DEVICE FOR ELECTRICALLY DISCHARGING SAMPLES OF AN ELECTRICALLY NON CONDUCTIVE LIQUID

(76) Inventors: Michael J. Blackburn, Morris, IL (US); Donald G. Flaynik, Jr., Channahon, IL (US)

( * ) Notice: Subject to any disclaimer, the term of this patent is extended or adjusted under 35 U.S.C. 154(b) by 356 days.

(21) Appl. No.: 12/462,982

(22) Filed: Aug. 12, 2009

(65) Prior Publication Data

US 2010/0039744 A1 Feb. 18, 2010

Related U.S. Application Data

(60) Provisional application No. 61/188,682, filed on Aug. 12, 2008.

(51) Int. Cl.
*H05F 3/00* (2006.01)

(52) U.S. Cl. ..... 361/215

(58) Field of Classification Search ..... 361/215
See application file for complete search history.

(56) References Cited

U.S. PATENT DOCUMENTS 5,031,469 A * 7/1991 Blackburn et al. ..... 73/864.63
5,754,388 A * 5/1998 Schmidt ..... 361/215
5,898,560 A * 4/1999 Flaynik et al. ..... 361/215

* cited by examiner

*Primary Examiner* — Dharti Patel
(74) *Attorney, Agent, or Firm* — Cherskov & Flaynik

(57) ABSTRACT

A device 10 for electrically discharging samples of an electrically non-conductive liquid includes an electrically conductive outer member 12, an electrically conductive inner member 14 disposed within the outer member 12, an electrically conductive rod 16 with upper and lower plugs 18 and 19 secured thereto to maintain a non-conductive fluid in the device 10, non-conductive handles 20 and 22 secured to the outer and inner members 12 and 14, and an electrically conductive ground cable 26 detachably secured to the rod 16 to ultimately remove or reduce static charge in the electrically non-conductive liquid via the liquid engaging the outer member 12, inner member 14 and rod 16, which are electrically grounded via the cable 26.

19 Claims, 12 Drawing Sheets

DEVICE FOR ELECTRICALLY DISCHARGING SAMPLES OF AN ELECTRICALLY NON CONDUCTIVE LIQUID

This application is based on Provisional Application No. 61/188,682, filed Aug. 12, 2008

BACKGROUND OF THE INVENTION

1. Field of the Invention

The present invention relates generally to devices for collecting samples from drums and vessels containing liquids and, more particularly, to collecting samples from drums and vessels containing electrically nonconductive liquid with an electrical static charge buildup thereupon.

2. Background of the Prior Art

Oil refineries and chemical plants routinely analyze hydrocarbon liquids in their process flow streams to determine if the resulting products meet specifications. Generally, a person will dip a collection tube into a drum, vessel or similar container to collect a sample of a hydrocarbon liquid within. After collecting a sample, the person carries the collection tube and sample therein back to a lab for analysis.

A dangerous situation occurs when a statically charged hydrocarbon liquid sample is collected. The statically charged hydrocarbon liquid in the collection tube can transfer a substantial quantity of the static charge to the collection tube, irrespective of the collection tube being fabricated from electrically conductive or nonconductive material, resulting in an electrical arc when the collection tube engages a grounded structure. The electrical arc can start a fire or initiate an explosion if the surrounding area provides an explosive atmosphere.

A need exists for a grounded metal collection tube that includes inner members capable of discharging the static charge from a nonconductive hydrocarbon liquid while the hydrocarbon liquid is collected from inside a barrel, vessel or similar container.

SUMMARY OF THE INVENTION

A principle object of the present invention is to provide a device for electrically discharging samples of an electrically nonconductive liquid. A feature of the device is an electrically conductive outer member. Another feature of the device is an electrically conductive inner member. Yet another feature of the device is an electrically conductive member that electrically connects the conductive inner member to the conductive outer member. An advantage of the device is that an electrically nonconductive liquid that is statically charged is allowed to enter the outer member via an open bottom and rise within the outer member to engage the inner and outer members, and the connecting member, thereby safely removing the static charge from a selected quantity of the nonconductive liquid that will ultimately be analyzed.

Another object of the present invention is to electrically ground the outer and inner members, and the connecting member before allowing the device to engage a statically charged nonconductive liquid. A feature of the device is a grounding cable with electrically conductive clamps attached to opposite ends of the grounding cable. Another feature of the device is a collar for detachably receiving one of the electrically conductive clamps, the collar being electrically connected to the inner member. An advantage of the device is that the collar and clamp cooperate to electrically ground the statically charged nonconductive fluid immediately upon contacting the outer and inner members, thereby preventing electrical arcs that could cause an explosion.

Yet another object of the present invention is to seal the outer member such that the collected sample therein will not escape after removing the device from a drum or vessel containing the electrically nonconductive liquid. A feature of the device is upper and lower plugs for the outer member that are forcibly urged into the outer member by a spring cooperating with a channel spacer. An advantage of the device is that the outer member and the sample therein can be manually transported to an analyzing location without endangering the person or the environment.

Briefly, the invention provides a device for electrically discharging samples of an electrically non-conductive liquid comprising an electrically conductive outer member; an electrically conductive inner member disposed within said electrically conductive outer member; means for allowing an electrically non-conductive liquid to enter said electrically conductive outer member when said device is disposed in the non-conductive liquid; means for electrically discharging the non-conductive liquid entering said outer conductive member; means for maintaining a selected volume of the non-conductive liquid in said outer conductive member after said device is removed from the non-conductive liquid; and means for electrically grounding said inner and outer electrically conductive members, and said electrical discharging means for the non-conductive liquid entering said outer conductive member.

The invention further provides a system for electrically discharging non-conductive liquid samples before being removed from a vessel comprising means for receiving a predetermined quantity of non-conductive liquid; means for electrically discharging the non-conductive liquid as the non-conductive liquid enters and fills said receiving means, said electrical discharging means comprising an electrically conductive inner member that engages the non-conductive liquid entering said receiving means; and means for grounding said electrically conductive inner member, said grounding means being detachably secured to said electrically conductive inner member and an electrically grounded structure; means for manually sealing a predetermined quantity of the non-conductive liquid in said receiving means; and means for manually releasing the non-conductive liquid from said receiving means, thereby providing a sample of the non-conductive liquid for evaluation.

The invention also provides a method for removing static charge from a selected quantity of non-conductive liquid, said method comprising the steps of providing an electrically conductive container with bottom and top apertures; inserting an electrically conductive inner member into said container, said inner member ultimately engaging an inner wall of said container; installing plugs on bottom and top portions of said inner member, said plugs being configured and dimensioned to seal said bottom and top apertures in said container after a selected quantity of non-conductive liquid has entered said container; providing means for manually urging said inner member in said container to ultimately seal said bottom and top apertures in said container via said plugs, said plugs being slidably disposed upon said inner member; and connecting grounding means to said inner member, whereby the non-conductive liquid entering said container is electrically discharged until said grounding means is detached from said inner member, whereupon, the container and the electrically discharged non-conductive liquid therein are transported to a testing lab.

BRIEF DESCRIPTION OF THE DRAWINGS

These and other objects, advantages an novel features of the present invention, as well as details of an illustrative embodiment thereof, will be more fully understood from the following detailed description and attached drawings, wherein.

DESCRIPTION OF THE PREFERRED EMBODIMENT

Figure 1:
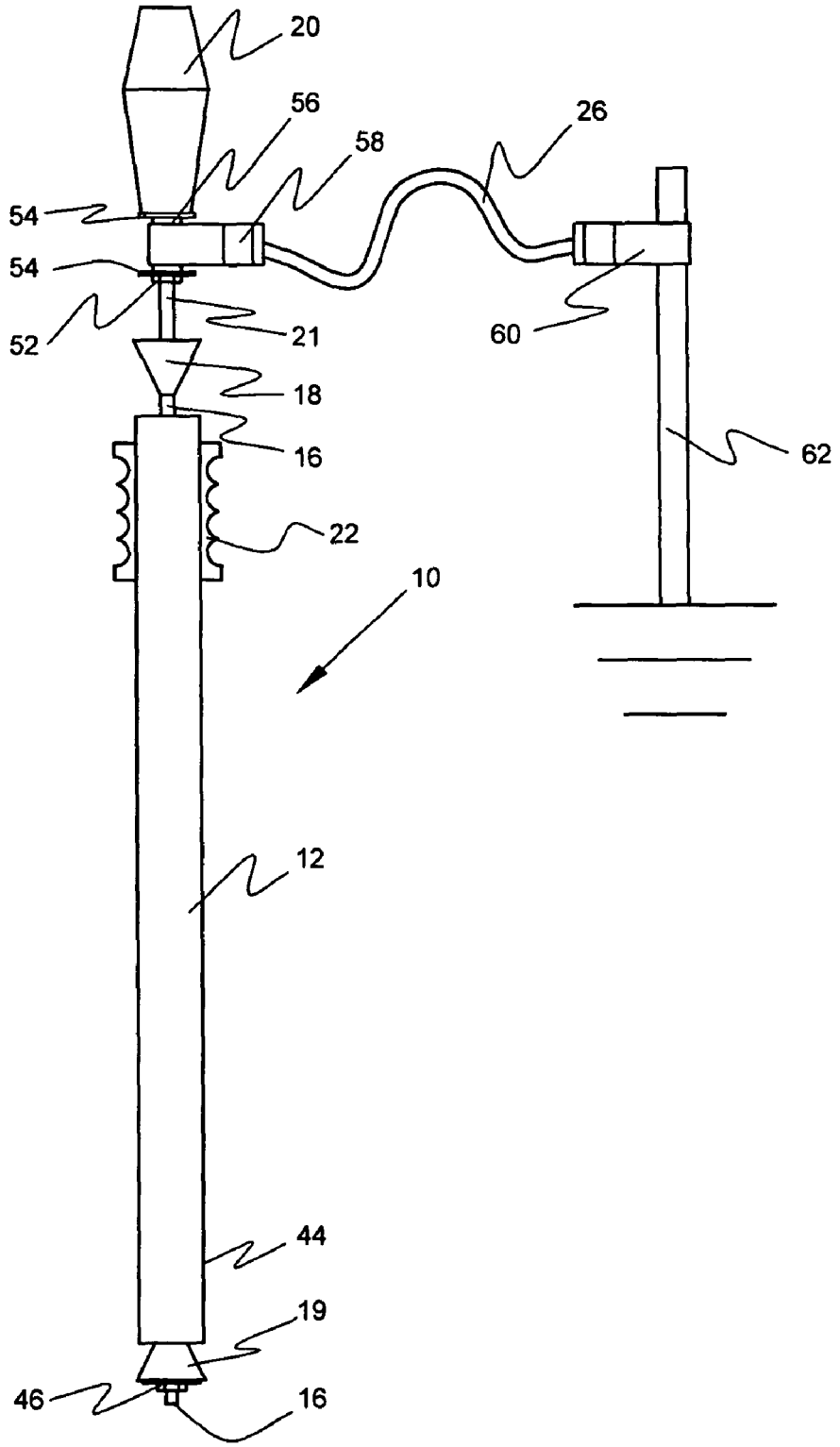
FIG. 1 is a front elevation view of a device for electrically discharging the static charge in samples of an electrically non-conductive liquid in accordance with the present invention.
Figure 2:
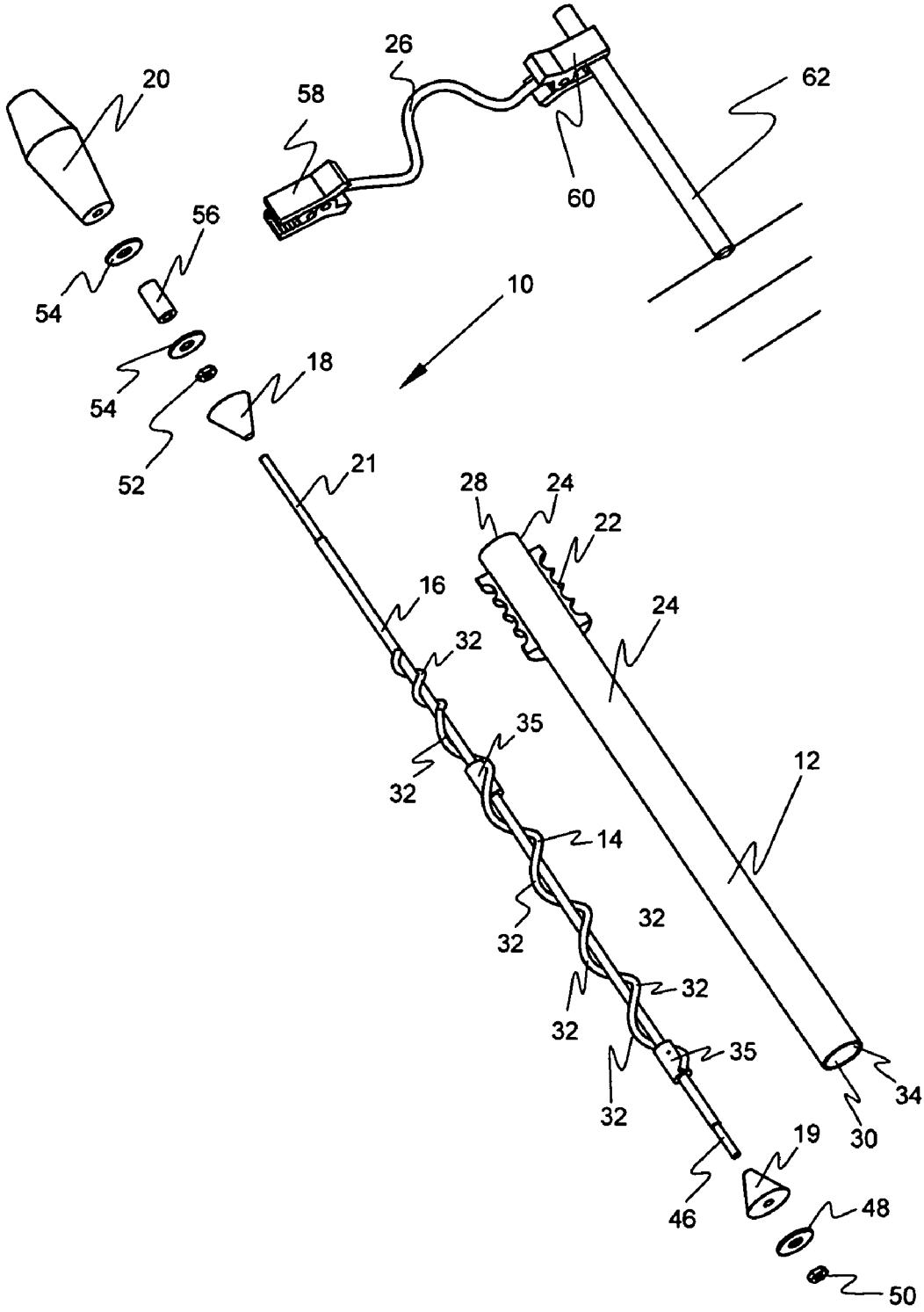
FIG. 2 is an exploded view of the device of FIG. 1.
Figure 3:
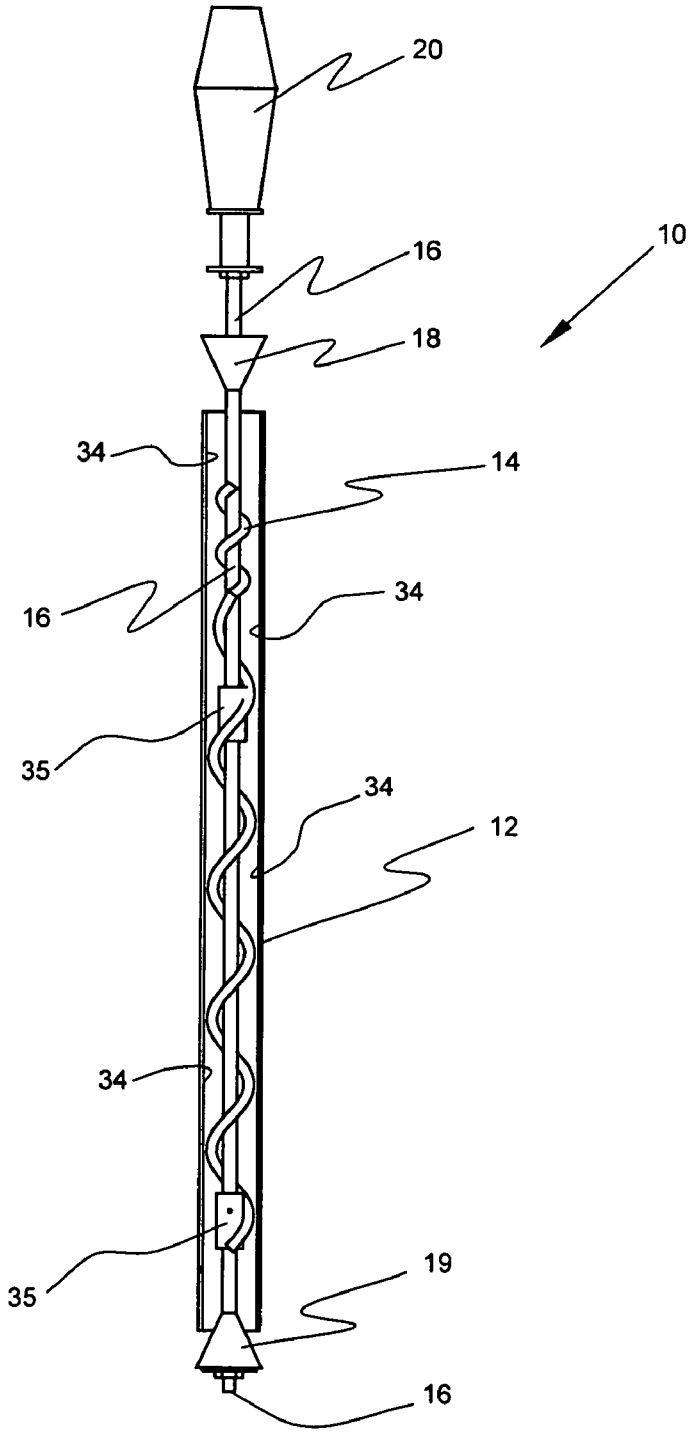
FIG. 3 is a phantom view of the device of FIG. 1 without the grounding cable.

Referring now to FIGS. 1 and 2, a device for electrically discharging the static charge on samples of an electrically non-conductive liquid in accordance with the present invention is denoted as numeral 10. The device 10 includes an electrically conductive outer member 12; an electrically conductive inner member 14 spirally disposed within the outer member 12; an electrically conductive rod 16 with upper and lower plugs 18 and 19 secured thereto to maintain a non-conductive fluid in the device 10, the rod 16 being electrically connected to the outer and inner members 12 and 14; an electrically non-conductive rod handle 20 secured to a top portion 21 of the rod 16 for manually disposing the rod 16 inside the outer member 12; an electrically non-conductive handle 22 secured to a top portion 24 of the outer member 12 for manually holding the outer member 12 while the rod 16 is manually disposed inside the outer member 12; and an electrically conductive ground cable 26 detachably secured to the rod 16, whereby the static charge in an electrically non-conductive liquid in a container or vessel is ultimately discharged to ground via the non-conductive liquid engaging the outer member 12, inner member 14 and rod 16, which are electrically grounded via the cable 26.

The outer member 12 is a thin-walled, cylindrically configured tube dimensioned to provide a volume that promotes insertion into a vessel or container to withdraw a predetermined volume of non-conductive liquid for testing and evaluation. The outer member 12 is manufactured from a relatively light weight electrically conductive metal such as aluminum or copper, and includes upper and lower apertures 28 and 30 to receive and remove the non-conductive liquid. The non-conductive handle 22 is fabricated from plastic or similar material and secured to the top portion 24 of the outer member 12. The handle 22 promotes the manual grasping of the outer member 12 while protecting the operator from static electricity in the non-conductive liquid when engaged by the outer member 12 as the operator inserts the device 10 into the liquid.

Figure 4:
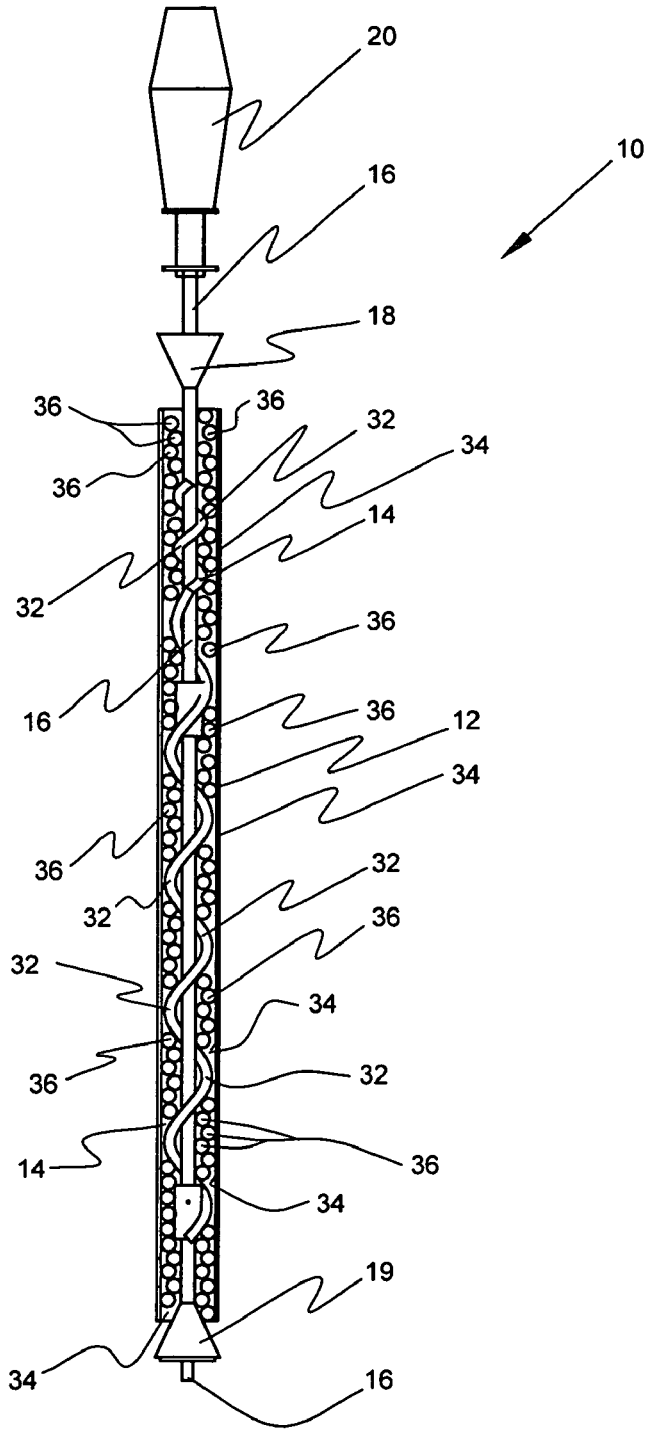
FIG. 4 is a phantom view of the device of FIG. 3, but with metal spheres included therein in accordance with the present invention.
Figure 5A:
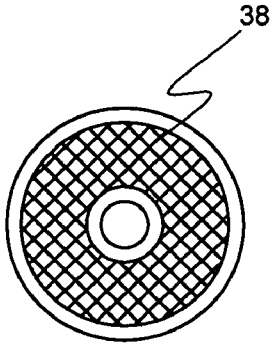
FIG. 5*a* is a top elevation view of the screens of FIG. 5.
Figure 5:
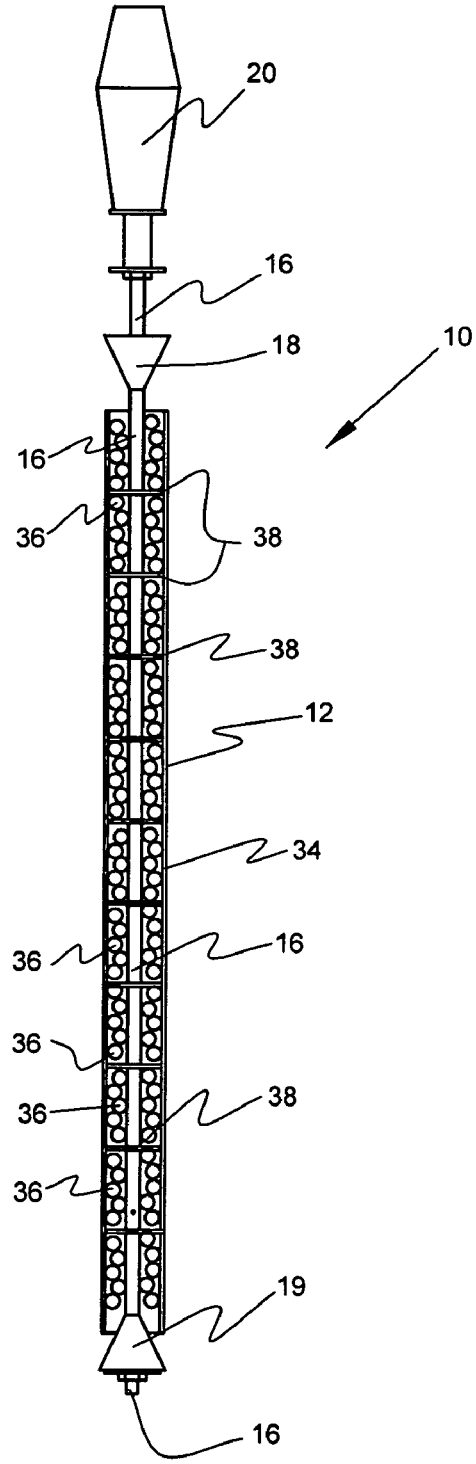
FIG. 5 is a phantom view of the device of FIG. 4, but with metal screens included therein in accordance with the present invention.
Figure 6A:
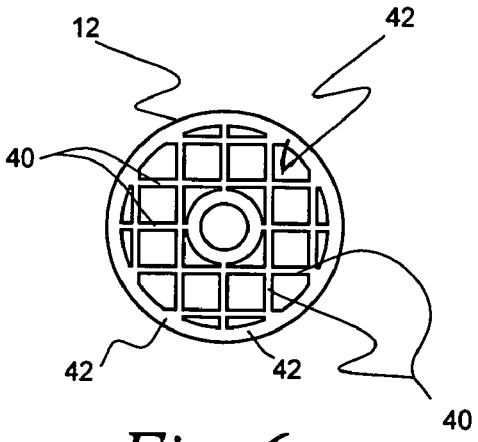
FIG. 6*a* is a top elevation view of the grid pattern of FIG. 6.
Figure 6:
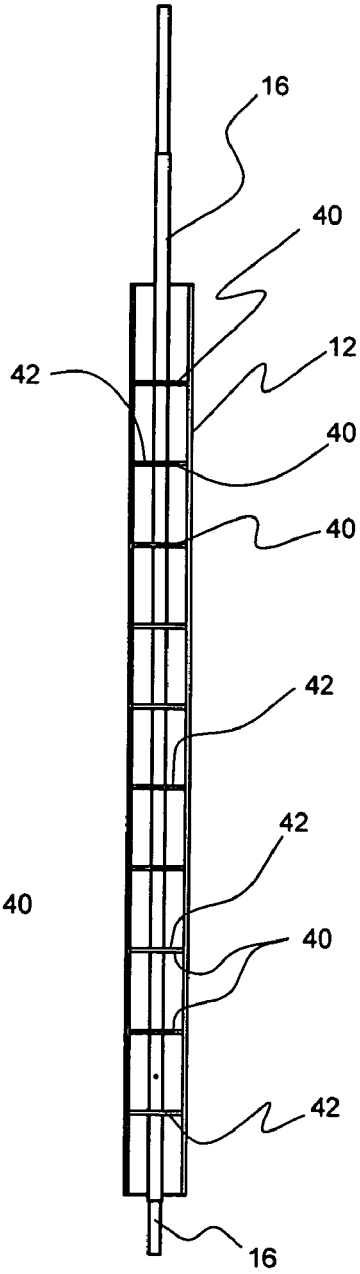
FIG. 6 is a phantom view of the device of FIG. 5, but with metal bars forming a grid pattern replacing the screens and spheres therein in accordance with the present invention.

The inner member 14 is an electrically conductive piece of copper or aluminum spiraling about the rod 16 such that outer portions 32 of the inner member 14 engage an inner cylindrical wall 34 of the outer member 12, thereby promoting electrical continuity between the outer and inner members 12 and 14, and the rod 16 to ultimately discharge the static charge in the non-conductive liquid collected in the outer member 12 to ground via the ground cable 26. The inner member 14 is secured to the rod via soldering or similar methods. Two enlarged couplings 35 are integrally secured to the rod 16 to provide a relative large surface area to better secure the inner member 14 to the rod 16. The spiraling inner member 14 is suitable for relatively viscous or "thick" liquids. In the event a relatively non-viscous or "thin" liquid requires discharging, a plurality of small spherical copper or aluminum balls 36 may be disposed in the outer member 12 (see FIG. 4) such that the balls 36 engage the inner and outer members 12 and 14, and the rod 16 to provide increased static discharge capability; or the balls 36 alone may fill the outer member 12 without the inner member 14, but including the rod 16 such that the balls 36 engage the outer member 12 and the rod 16. Alternatively, a series of conductive screens 38 may replace the inner member 14 (see FIGS. 5 and 5*a*), or a combination of screens 38 and balls 36 can be utilized. Further, a plurality of relative long, "thin" copper or aluminum "flat bars" 40 may be integrally joined to form a grid 42 configuration (see FIGS. 6 and 6*a*).

Irrespective of the configuration of electrically conductive elements included in the outer member 12, the goal is to remove the electrostatic charge from the non-conductive liquid before the device 10 is manually removed from the vessel or container holding the non-conductive liquid. The electrostatic charge is removed via the non-conductive liquid entering the lower aperture 30 of the outer member 12, then rising within the outer member 12 and around or through the inner member 14 and/or balls 36, screens 38 or flat bars 40 until rising to a level that provides a sufficient volume of electrostatically discharged, non-conductive liquid for laboratory testing and evaluation. The more engagement between the volume of non-conductive liquid and the outer member 12, inner member 14 or substitute elements, and the rod 16, the lower the electrostatic charge remaining on the non-conductive liquid when the device is removed from the vessel or container, thereby reducing the chance of an electrostatic arc which could cause a fire or explosion in the event of combustive or explosive vapors being present.

The non-conductive liquid is manually collected in the device 10 by the operator holding the device 10 via non-conductive handles 20 and 22 to prevent the operator from being exposed to a static charge, the operator then pushes on the handle 20 secured to the top portion 21 of the rod 16 by threads or similar methods, until a frustoconically configured lower plug 19, manufactured from a deformable material such as rubber or a conductive or semi-conductive material, is separated from the lower aperture 30. The lower plug 19 is dimensioned to cooperate with the diameter of the lower aperture 30 such that the lower plug 19 is capable of sealing the bottom end of the outer member 12 after the non-conductive liquid enters the outer member 12. The operator then grounds the rod 16, the inner and outer members 14 and 12 electrically connected thereto, and any balls 36 or screens 38 inside the outer member 12 by manually attaching a first clamp 58 to a collar 56 and a second clamp 60 to a ground bar 62 or similar well grounded metal structure, the ground cable 26 provides electrical continuity between the clamps 58 and 60. The operator then inserts the lower end 44 of the outer member 12 into the non-conductive liquid such that a tip portion 46 of the rod 16 first engages the liquid, thereby reducing the chance of an arc between the surface of the non-conductive liquid and the device 10. The operator inserts the lower end 44 of the outer member 12 deeper into the liquid until the liquid rises inside the outer member 12 to a level that provides a predetermined volume of liquid inside the device 10 for removal from the container, whereupon, the operator pulls the rod handle 20 upward until the lower plug 19 is re-inserted into the lower aperture 30 to prevent the non-conductive liquid from escaping from the outer member 12. To prevent the liquid from spilling from the upper aperture 28 in the outer member 12, the upper plug 18, manufactured from the same deformable frustoconically configured material as the lower plug 19, is manually pushed into the upper aperture 28, thereby sealing the non-conductive liquid inside the device 10, and allowing the device 10 to be removed from the container; whereupon, the second clamp 60 is ultimately detached from the ground bar 62 and the device 10 with the non-conductive liquid therein is transported by the operator to a distal location where the liquid is tested and/or evaluated.

The lower plug 19 is removably secured to the threaded tip portion 46 of the rod 16 by a washer 48 and nut 50. The upper plug 18 is slidably maintained on the treaded top portion 21 of the rod 16 by a nut 52. The nut 52 cooperates with two washers 54 and the rod handle 20 to maintain the longitudinal position of the metal collar 56 upon the top portion 21 of the rod 16 such that the rod 16 is electrically connected to the collar 56, resulting in electrical continuity between the rod 16, the metal clamps 58 and 60, the cable 26 and the grounded bar 62 to effectively ground the static charge in the collected non-conductive liquid. The collar 56 detachably receives the first clamp 58 which is secured to a first end of the grounding cable 26. A second end of the grounding cable 26 is secured to the second clamp 60 which detachably secured to the selected grounded metal bar 62 or similar grounded structure.

Figure 7:
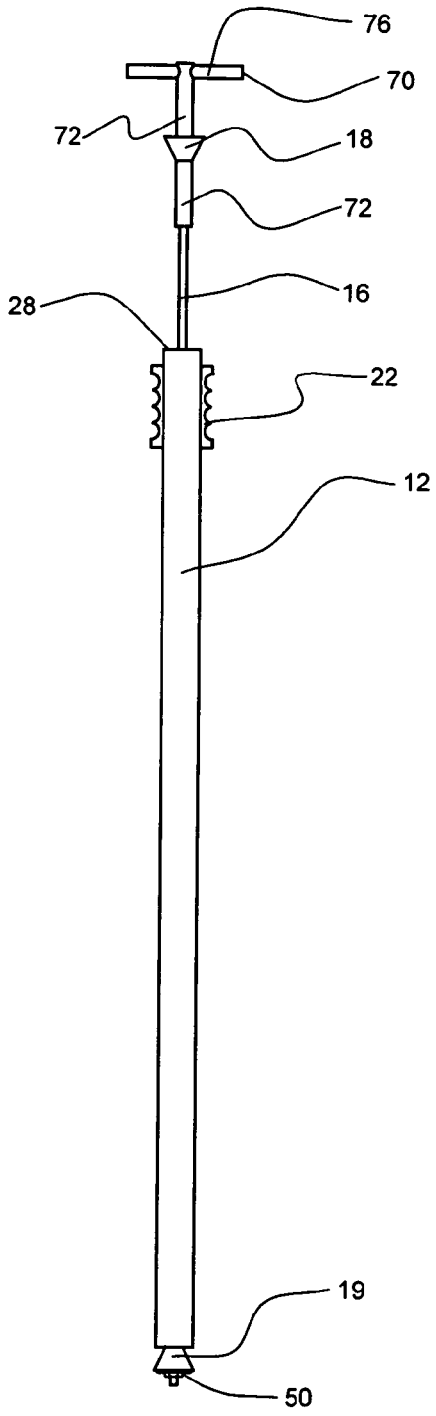
FIG. 7 is a front elevation view of the device of FIG. 1, but with an alternative handle design in accordance with the present invention.
Figure 8:
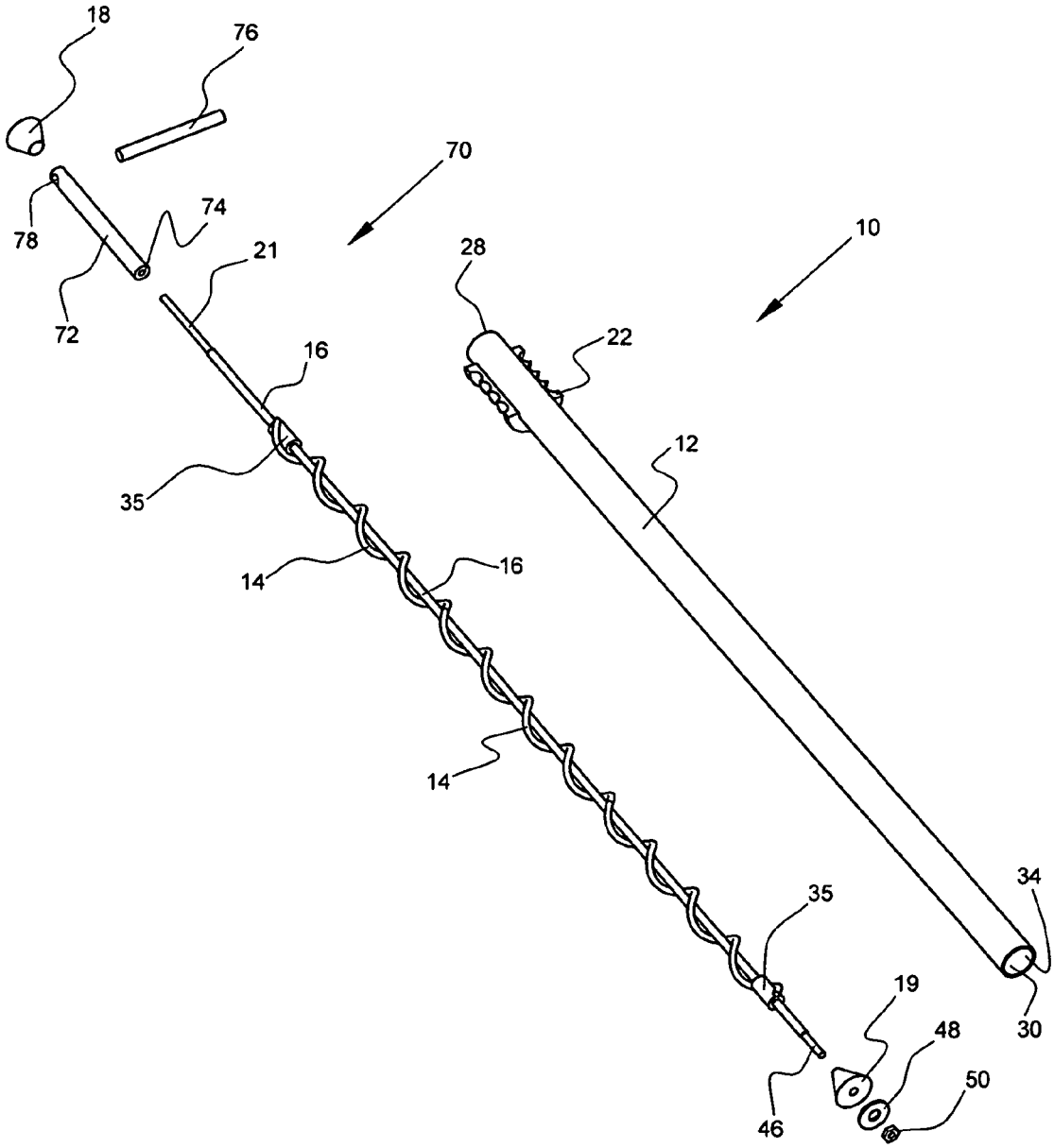
FIG. 8 is an exploded view of the device of FIG. 7.
Figure 9:
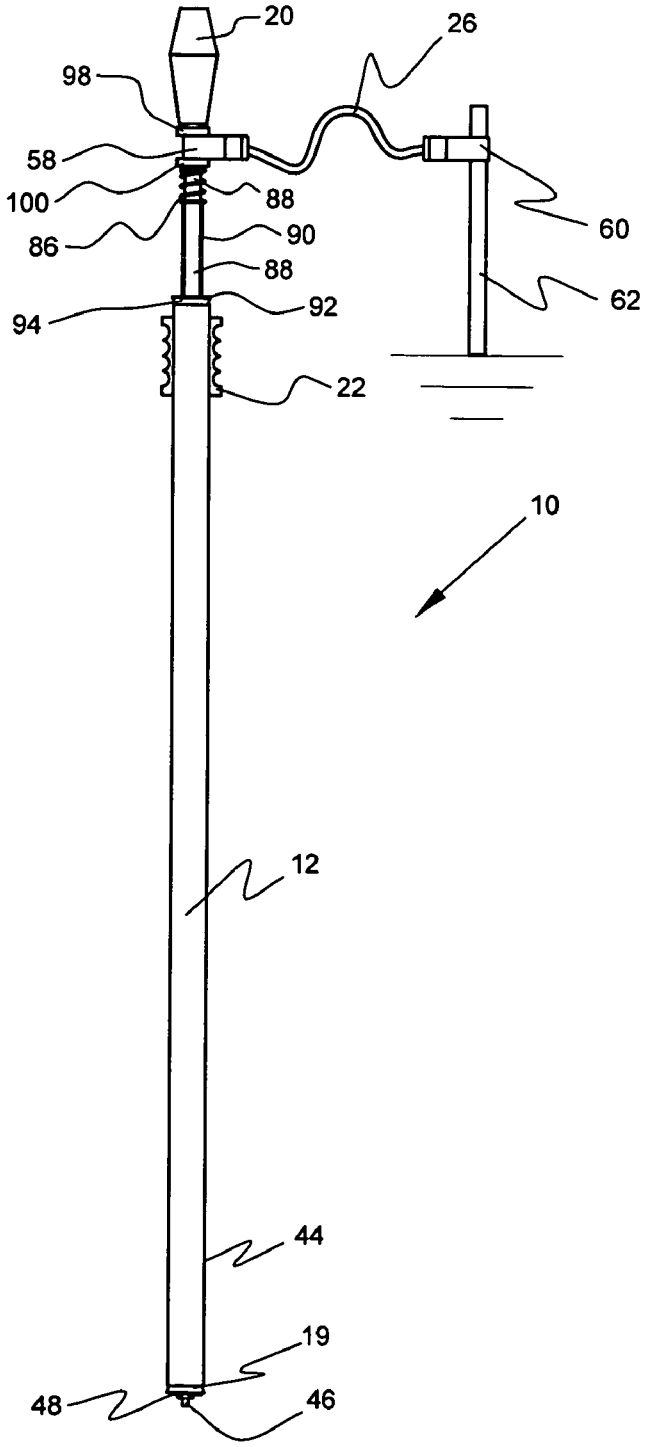
FIG. 9 is a front elevation view of the device of FIG. 1, but with a modified upper portion in accordance with the present invention. The device of FIG. 9 is depicted with a lower plug disposed in a closed position to prevent a sample from escaping an outer member of the device.
Figure 10:
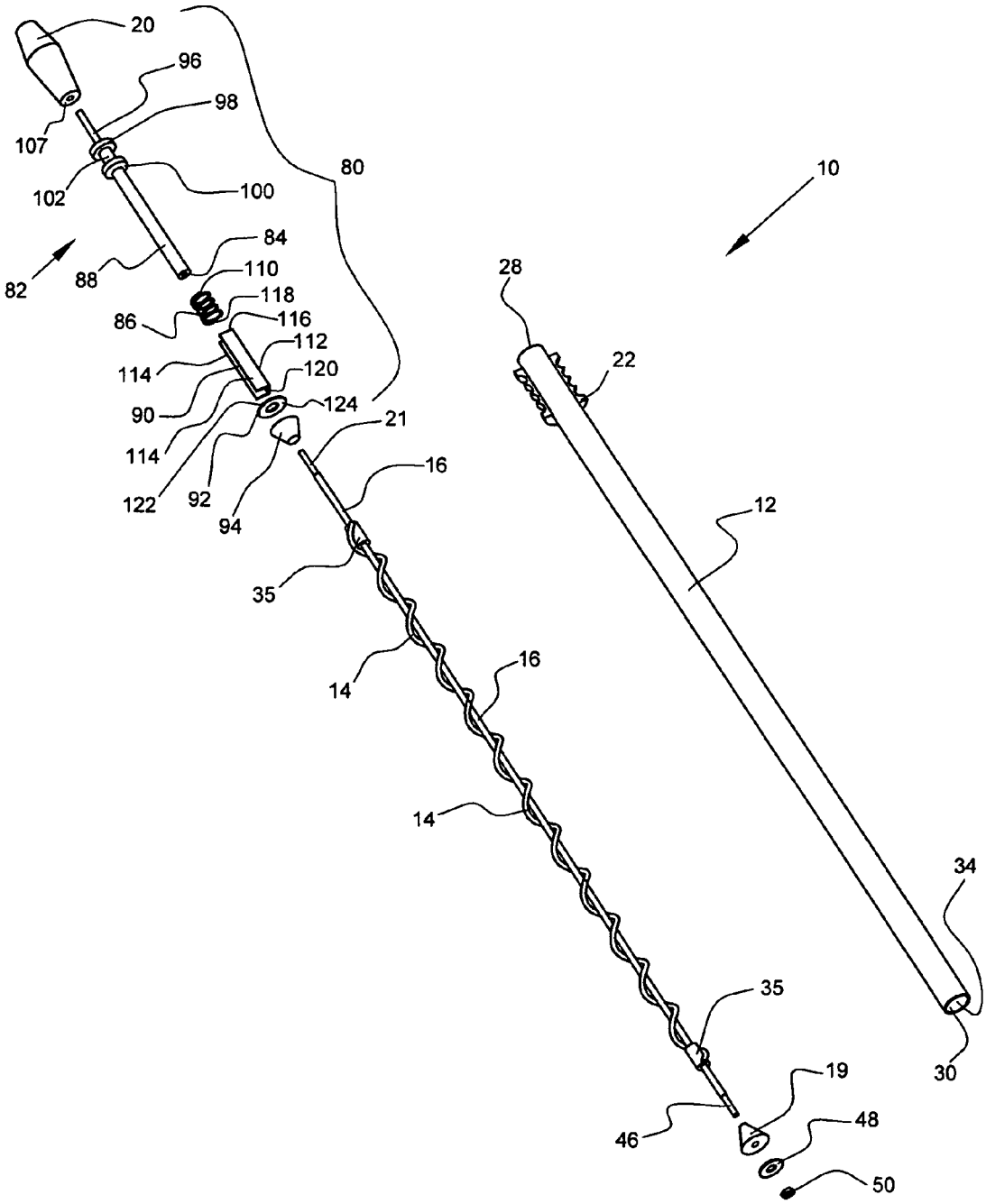
FIG. 10 is an exploded perspective view of the device of FIG. 9.
Figure 11:
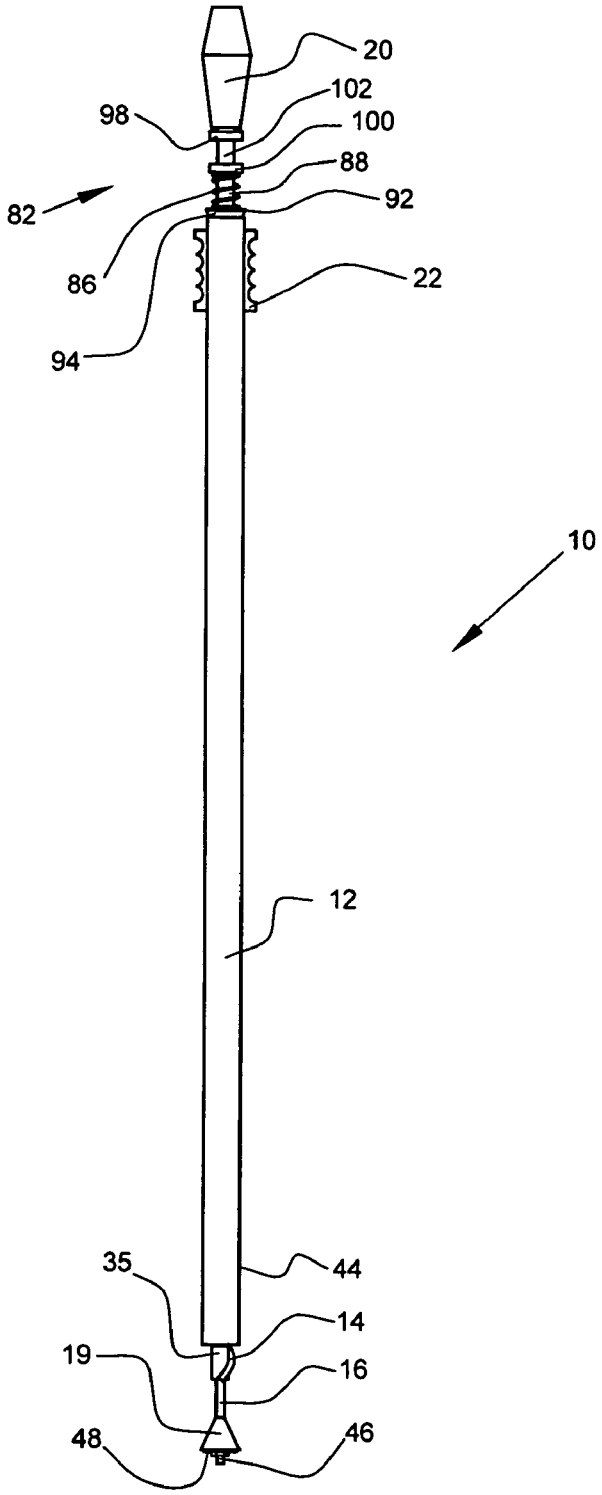
FIG. 11 is a front elevation view of the device of FIG. 9, but with a channel spacer removed and a lower plug disposed in an open position to allow a sample to flow into an outer member of the device in accordance with the present invention.
Figure 12:
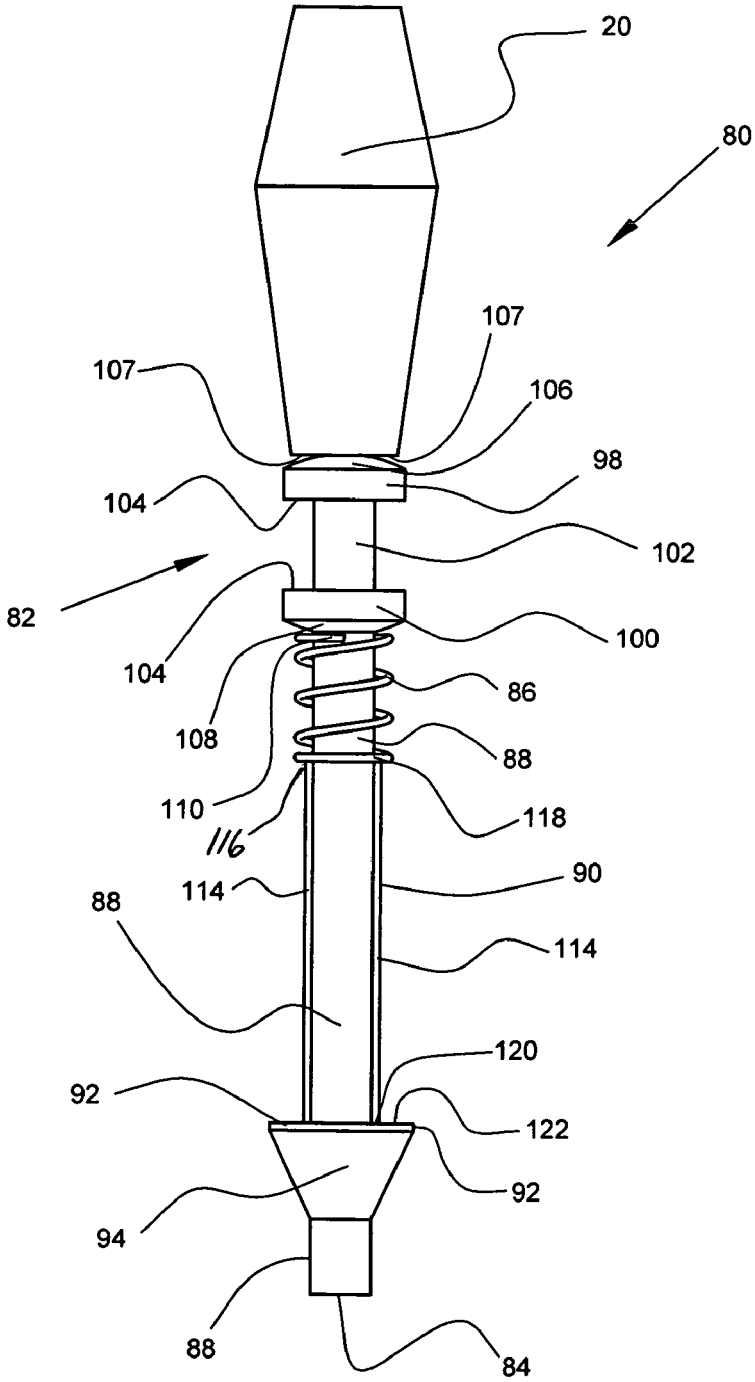
FIG. 12 is a front elevation view of the modified upper portion of FIG. 9.

Referring now to FIGS. 7 and 8, an alternative design for the handle of the device 10 is depicted and designated as numeral 70. The handle is manufactured from a non-conductive material and includes a "T" configuration to promote better grasping by the operator to allow the operator impart more force upon device 10 when inserting or removing the upper and lower plugs 18 and 19 from cooperating upper and lower apertures 28 and 30. The handle 70 is secured to the top portion 21 of the rod 16 by threads such that the top portion 21 is completely threaded and inserted into a base portion 72 of the handle 70 to ultimately dispose a tip portion 74 of the base portion 72 into the upper aperture 28 in the outer member 12, thereby stabilizing the handle 70 after the upper plug 18 is slid down the base portion into the upper aperture 28. A cross member 76 is snugly and removably inserted through an aperture 78 in the base portion. The cross member 76 is configured and dimensioned such that the operator's entire hand grasps the cross member 76, thereby promoting increased manual force longitudinally upon the rod 16, resulting in tighter seals between the upper and lower plugs 18 and 19, and cooperating ends of the outer member 12.

Referring now to FIGS. 9-12, a modified upper portion for the device 10 in accordance with the present invention is denoted as numeral 80. The modified upper portion 80 includes an elongated collar 82 with a threaded aperture 84 that rotationally receives the threaded top portion 21 of the conductive rod 16, a cylindrical spring 86 that slides upon a cylindrical lower portion 88 of the elongated collar 82, a channel spacer 90 that is forcibly disposed upon the lower portion 88 of the elongated collar 82, a washer 92 that slides upon the lower portion 88, and an upper plug 94 that is forcibly disposed upon the lower portion 88.

The elongated collar 82 is manufactured from a single piece of aluminum and further includes a threaded cylindrical top portion 96 that rotationally inserts into the handle 20, and first and second cylindrical clamp retainers 98 and 100 with a cylindrical clamp portion 102 therebetween for receiving the first clamp 58. The first and second clamp retainers 98 and 100 are separated a distance corresponding to the axial dimension of the clamp portion 102 required to allow the first clamp 58 to snugly insert between the first and second clamp retainers 98 and 100, then be removably secured to the clamp portion 102. The first and second clamp retainers 98 and 100 have planar inner walls 104 with radial dimensions sufficient to engage and retain the first clamp 58, thereby preventing the clamp 58 from sliding off the clamp portion 102. The first clamp retainer 98 includes an arcuate outer wall 106 configured to snugly engage a bottom portion 107 of the handle 20. The second clamp retainer 100 includes a conically configured outer wall 108 dimensioned to cooperatively engage a first end 110 of the spring 86, such that the spring remains concentrically disposed about the lower portion 88 when compressed, thereby preventing the spring 86 from engaging and damaging the lower portion 88.

The lower portion 88 includes an axial dimension that is relatively longer than the combined axial dimensions of the spring 86 (not compressed), channel spacer 90, washer 92 and upper plug 94, thereby preventing the upper plug 94 from sliding off the elongated collar 82 during operation of the device 10. The spring, washer 92 and upper plug 94 must be slid upon the elongated collar 82 before the threaded top portion 21 of the conductive rod is rotationally inserted into the elongated collar 82. The channel spacer 90 has one side open and therefore can be disposed upon the lower portion 88 after the top portion 21 is rotationally secured to the lower portion 88.

The spring 86 is manufactured from stainless steel and includes an axial dimension approximately one-half the longitudinal dimension of the channel spacer 90 when the spring 86 is in a non-compressed state. The axial dimension of the spring 86 and longitudinal dimension of the channel spacer 90 cooperate to maintain sufficient pressure on the upper plug 94 to prevent the upper plug 94 and/or the lower plug 19 from allowing a sample collected in the outer member 12 from escaping until the collected sample is intended to be removed from the outer member 12. The spring 86 includes an inner diameter slightly longer than the outer diameter of the lower portion 88, and an outer diameter relatively smaller than the outer diameter of the second clamp retainer 100, thereby allowing the spring 86 to snugly slide onto the lower portion 88 until engaging the conical outer wall 108 of the second clamp retainer 100. The spring 86 compression parameters are such that a person using the device 10 can compress the spring 86 to a position that ultimately provides sufficient bias to the channel spacer 90 to maintain the positions of the upper and lower plugs 94 and 19 in the outer member 12 such that no sample will escape the outer member 12.

The channel spacer 90 includes a base side 112 and two retaining sides 114 perpendicularly joined to the base side 112 such that the retaining sides 114 are laterally separated a distance slightly less than the outer diameter of the lower portion 88. The lateral separation of the retaining sides 114 allows an operator of the device 10 to forcibly urge the base side 112 and the retaining sides 114 of the channel spacer 90 into longitudinal engagement with the lower portion 88, thereby providing a bias that retains the channel spacer 90 upon the lower portion 88 after the operator releases the channel spacer 90. After the operator takes a sample and forces the upper and lower plugs 94 and 19 into the outer member 12, the spring 86 is compressed and the channel spacer 90 inserted between the spring 86 and washer 92 such that a first end 116 of the channel spacer 90 forcibly engaging a second end 118 of the spring 86, a second end 120 of the channel spacer 90 forcibly engaging a first side 122 of the washer 92, and a second side 124 of the washer 92 forcibly engages the upper plug 94, thereby maintaining the upper and lower plugs 94 and 19 in the outer member 12.

The washer 92 is manufactured from stainless steel and dimensioned to engage the second end 120 of the channel spacer 90 and the upper plug 94. The upper plug 94 is configured and dimensioned substantially the same as the lower member 19, except that the axial aperture through the upper plug 94 has a diameter relatively larger than the diameter of the axial aperture through the lower member 19. Also, the axial aperture through the upper plug 94 is relatively smaller than the outer diameter of the lower portion 88 of the elongated collar 82 to forcibly maintain the upper plug 94 upon the lower portion 88 during slidable operation of the upper plug 94 upon the lower portion 88 when collecting samples with the device 10.

In operation, a device 10 having a modified upper portion 80 is grounded via the first clamp 58 detachably secured to the clamp portion 102 of the elongated collar 82, and the second clamp 60 detachably secured to a grounded metal bar 62 or similar grounded structure. The channel spacer 90 is removed and the lower portion 88 of the elongated collar 82 is forced into the outer member 12 via the handle 20 to force the lower plug 19 out of the lower aperture 30 of the outer member 12. The device 10 is then inserted into a tank, drum or vessel to collect a sample. Upon collecting a sample, the lower plug 19 is urged back into the lower aperture 30 of the outer member 12 to capture the sample, whereupon, the upper plug 94 is forcibly urged into the upper aperture 28 in the outer member 12 via the washer 92, the first end 110 of the spring 86 is compressed against the conical outer wall 108 of the second clamp retainer 100 via the first end 116 of the channel spacer 90 forcibly urging the second end 118 of the spring 86 axially toward the conical outer wall 108, and the channel spacer 90 is disposed upon the lower portion 88 of the elongated collar 82 such that the second end 120 of the channel spacer 90 forcibly engages the first side 122 of the washer 92, thereby forcibly and constantly urging the upper and lower plugs 94 and 19 into the outer member 12 to maintain the sample within the outer member after the outer member 12 is withdrawn from the tank, drum or vessel.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A device for electrically discharging samples of an electrically non-conductive liquid comprising:

an electrically conductive outer member;

an electrically conductive inner member disposed within said electrically conductive outer member, said electrically conductive inner member including an elongated collar with a threaded aperture that rotationally receives a threaded top portion of a conductive rod, a cylindrical spring that slides upon a cylindrical lower portion of said elongated collar, a channel spacer that is forcibly disposed upon said cylindrical lower portion of said elongated collar, a washer that slides upon said cylindrical lower portion of said elongated collar, and an upper plug that is forcibly disposed upon said cylindrical lower portion of said elongated collar;

means for allowing an electrically non-conductive liquid to enter said electrically conductive outer member when said device is disposed in the non-conductive liquid;

means for electrically discharging the non-conductive liquid entering said outer conductive member;

means for maintaining a selected volume of the non-conductive liquid in said outer conductive member after said device is removed from the non-conductive liquid; and means for electrically grounding said inner and outer electrically conductive members, and said electrically discharging means for the non-conductive liquid entering said outer conductive member.

2. The device of claim 1 wherein said electrically conductive outer member includes cylindrically configured inner and outer walls.

3. The device of claim 1 wherein said electrically conductive inner member includes a cylindrically configured outer wall.

4. The device of claim 1 wherein said elongated collar includes a threaded cylindrical top portion that rotationally inserts into a handle, and first and second cylindrical clamp retainers with a cylindrical clamp portion therebetween for receiving a first clamp of said electrical grounding means for electrically grounding said conductive inner and outer members.

5. The device of claim 1 wherein said electrical discharging means includes a spiral conductive member disposed to engage the electrically inner and outer conductive members.

6. The device of claim 1 wherein said cylindrical spring includes an inner diameter slightly longer than an outer diameter of said lower portion of said elongated collar, and an outer diameter relatively shorter than an outer diameter of a second clamp retainer, thereby allowing said spring to snugly slide onto said lower portion until engaging a conical outer wall of said second clamp retainer, said cylindrical spring including compression parameters that allow a person using said device to compress said cylindrical spring to a position that ultimately provides sufficient bias to a channel spacer to maintain the positions of said upper plug and a lower plug in said electrically conductive outer member such that no sample will escape from said electrically conductive outer member.

7. The device of claim 1 wherein said inner conductive member receives upper and lower plugs slidably secured to bottom and top portions of said electrically conductive inner member.

8. The device of claim 7 wherein said upper and lower plugs are frustoconically configured and dimensioned to cooperate with the inner diameter of said electrically conductive outer member, such that said plugs are capable of sealing bottom and top openings in said outer conductive member after a non-conductive liquid enters said outer conductive member, thereby allowing said non-conductive liquid to be transported via an operator grasping said device to ultimately release the non-conductive liquid from said device for testing and/or evaluation.

9. The device of claim 7 wherein said upper and lower plugs are fabricated from a deformable material capable of returning to an original configuration.

10. The device of claim 7 wherein said upper and lower plugs are fabricated from a semi-conductive material.

11. The device of claim 1 wherein said electrically conductive inner member includes a tip portion that engages the non-conductive liquid before any other portion of the device, thereby reducing spark intensity when the device engages the non-conductive liquid.

12. The device of claim 1 wherein said electrical discharging means includes a plurality of conductive spheres disposed within said electrically conductive outer member such that said conductive spheres provide a conductive path between said electrically conductive outer and inner members.

13. The device of claim 1 wherein said electrical discharging means includes a conductive grid disposed within said conductive outer member such that said conductive grid provides a conductive path between said outer and inner conductive members.

14. The device of claim 1 wherein said electrical discharging means includes conductive screens disposed within said conductive outer member such that said conductive screens provide a conductive path between said outer and inner conductive members.

15. The device of claim 1 wherein said electrical grounding means includes an electrically conductive collar secured to a top portion of said electrically conductive inner member.

16. The device of claim 15 wherein said electrical grounding means includes a grounding cable with connecting members secured to each end of said grounding cable, said connecting members ultimately being secured to said conductive collar and an electrically grounded structure.

17. The device of claim 1 wherein said electrically conductive inner member includes a handle secured to a top end of said inner conductive member, said handle promoting the manually plugging and un-plugging of a bottom opening in said outer conductive member via a lower plug.

18. A system for electrically discharging non-conductive liquid samples before being removed from a vessel comprising:

means for receiving a predetermined quantity of non-conductive liquid;

means for electrically discharging the non-conductive liquid as the non-conductive liquid enters and fills said receiving means, said electrical discharging means comprising:

an electrically conductive inner member that engages the non-conductive liquid entering said receiving means, said electrically conductive inner member including an elongated collar with a threaded aperture that rotationally receives a threaded top portion of a conductive rod, a cylindrical spring that slides upon a cylindrical lower portion of said elongated collar, a channel spacer that is forcibly disposed upon said cylindrical lower portion of said elongated collar, and a washer that slides upon said cylindrical lower portion of said elongated collar; and means for grounding said electrically conductive inner member, said grounding means being detachably secured to said electrically conductive inner member and an electrically grounded structure;

means for manually sealing a predetermined quantity of the non-conductive liquid in said receiving means; and means for manually releasing the non-conductive liquid from said receiving means, thereby providing a sample of the non-conductive liquid for evaluation.

19. A method for removing static charge from a selected quantity of non-conductive liquid, said method comprising the steps of:

providing an electrically conductive container with bottom and top apertures;

inserting an electrically conductive inner member into said container, said inner member ultimately engaging an inner wall of said container, said electrically conductive inner member including an elongated collar with a threaded aperture that rotationally receives a threaded top portion of a conductive rod, a cylindrical spring that slides upon a cylindrical lower portion of said elongated collar, a channel spacer that is forcibly disposed upon said cylindrical lower portion of said elongated collar, and a washer that slides upon said cylindrical lower portion of said elongated collar;

installing plugs on bottom and top portions of said inner member, said plugs being configured and dimensioned to seal said bottom and top apertures in said container after a selected quantity of non-conductive liquid has entered said container;

providing means for manually urging said inner member in said container to ultimately seal said bottom and top apertures in said container via said plugs, said plugs being slidably disposed upon said inner member; and connecting grounding means to said inner member, whereby the non-conductive liquid entering said container is electrically discharged until said grounding means is detached from said inner member, whereupon, the container and the electrically discharged non-conductive liquid therein are transported to a testing lab.

* * * * *